US008915484B2

(12) United States Patent
Harward et al.

(10) Patent No.: US 8,915,484 B2
(45) Date of Patent: Dec. 23, 2014

(54) FLUID DELIVERY VALVE HAVING A COMPRESSION MEMBER

(76) Inventors: Kelly A. Harward, Layton, UT (US); Toby Hazelbaker, Pleasant Grove, UT (US); Kirk D. Hagen, Ogden, UT (US)

( * ) Notice: Subject to any disclaimer, the term of this patent is extended or adjusted under 35 U.S.C. 154(b) by 533 days.

(21) Appl. No.: 12/815,098

(22) Filed: Jun. 14, 2010

(65) Prior Publication Data

US 2011/0056992 A1 Mar. 10, 2011

Related U.S. Application Data

(60) Provisional application No. 61/186,840, filed on Jun. 13, 2009.

(51) Int. Cl.

| | |
|---|---|
| ***F16K 1/36*** | (2006.01) |
| ***F16K 31/00*** | (2006.01) |
| ***B65D 5/72*** | (2006.01) |
| ***A45F 3/20*** | (2006.01) |

(52) U.S. Cl.
CPC ..... *A45F 3/20* (2013.01)
USPC ..... 251/358; 251/342; 222/490

(58) Field of Classification Search
USPC ..... 222/175, 212, 213, 95, 490, 494; 215/11.4, 11.6; 220/703; 224/148.2; 604/77, 41; 128/200.26, 207.15, 128/207.14; 251/341, 342, 358
See application file for complete search history.

(56) References Cited

U.S. PATENT DOCUMENTS

| | | | | |
|---|---|---|---|---|
| 2,176,513 | A * | 10/1939 | Smith | 222/92 |
| 2,730,274 | A * | 1/1956 | Brown | 222/490 |
| 5,940,880 | A * | 8/1999 | Phillips | 2/7 |
| 6,062,435 | A * | 5/2000 | Hess, III | 222/175 |
| 6,557,721 | B2 * | 5/2003 | Yang | 220/713 |
| 7,028,929 | B2 * | 4/2006 | Yang | 239/597 |
| 8,083,105 | B2 * | 12/2011 | Reichert et al. | 222/175 |
| 2002/0011583 | A1 * | 1/2002 | Getzewich et al. | 251/342 |
| 2003/0222238 | A1 * | 12/2003 | Getzewich et al. | 251/342 |
| 2004/0159820 | A1 * | 8/2004 | Yang | 251/342 |
| 2006/0243765 | A1 * | 11/2006 | Valeriana | 224/148.2 |
| 2009/0140005 | A1 * | 6/2009 | Reichert et al. | 222/95 |

* cited by examiner

*Primary Examiner* — Kevin P Shaver
*Assistant Examiner* — Stephanie E Williams
(74) *Attorney, Agent, or Firm* — Maschoff Brennan

(57) ABSTRACT

A fluid delivery valve and system including a neck portion adapted to connect to a fluid delivery tube; a head portion comprising a dispensing face with a perimeter and a slit; and a compression member disposed in the head portion which is adapted to apply a force to the slit.

16 Claims, 9 Drawing Sheets

FLUID DELIVERY VALVE HAVING A COMPRESSION MEMBER

CROSS-REFERENCE TO RELATED APPLICATIONS

This application claims the benefit of U.S. Provisional Patent Application Ser. No. 61/186,840, filed Jun. 13, 2009, entitled "Improved Fluid Delivery Valve Having a Compression Member," which is incorporated herein by reference.

BACKGROUND OF THE INVENTION

1. The Field of the Invention

The present invention relates to elastomeric fluid delivery valves. More specifically, the present invention relates to an elastomeric fluid delivery valve which is capable of delivering fluid at increased pressure.

2. The Relevant Technology

Recently, various technologies have emerged which use various means to apply pressure to fluid within the fluid storage and delivery systems in order so as force the fluid from a storage reservoir of the fluid storage system towards the delivery mechanism. One problem with these configurations, however, is that elastomeric fluid delivery valves currently used in the art are typically not designed so as to withstand the pressure applied to the fluid. Thus, the fluid delivery valves may deform, resulting in leaks or other problems with the system. Thus, there is a need for a fluid delivery vale which is capable of withstanding the increased pressure.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF THE INVENTION

These and other limitations are overcome by embodiments of the invention which relate to systems and methods for storing and delivering a fluid from a fluid bladder. As described more fully below, the systems provide a method of pressurizing the fluid stored in the fluid bladder so that the fluid may be more easily delivered from the fluid bladder than in previous systems known in the art.

A first aspect of the invention is a fluid delivery valve including a neck portion adapted to connect to a fluid delivery tube, a head portion comprising a dispensing face with a perimeter and a slit, and a compression member disposed so as to surround the perimeter of the head portion, wherein the compression member is adapted to apply a force to the slit.

A second aspect of the invention is a fluid delivery valve including a neck portion adapted to connect to a fluid delivery tube, a head portion having a hollow interior and extending from the neck portion, the head portion comprising a dispensing face having an exterior surface and an interior surface, the face also having a slit formed so as to extend from the interior surface to the exterior surface along a longitudinal axis, and the head portion also having lips formed on each side of the slit having an extending portion which extends towards the hollow interior from the interior surface of the face, and a compression member disposed in the hollow interior of the head portion which is adapted so as to surround the lips.

A third aspect of the invention is a fluid delivery system including a collapsible fluid reservoir having a filling port and a fluid exit port and being adapted so as to be pressurized by a pressuring means, a fluid delivery tube having a proximal end connected to the fluid exit port and a distal end, and a fluid delivery valve. The fluid delivery valve includes a neck portion adapted to connect to the distal end of the fluid delivery tube, a head portion comprising a dispensing face with a perimeter and a slit; and a compression member disposed so as to surround the perimeter of the head portion, wherein the compression member is adapted to apply a force to the slit.

A fourth aspect of the invention is a fluid delivery system including a collapsible fluid reservoir having a filling port and a fluid exit port and being adapted so as to be pressurized by a pressuring means, a fluid delivery tube having a proximal end connected to the fluid exit port and a distal end; and a fluid delivery valve. The fluid delivery valve includes a neck portion adapted to connect to the distal end of the fluid delivery tube, a head portion having a hollow interior and extending from the neck portion, the head portion comprising a dispensing face having an exterior surface and an interior surface, the face also having a slit formed so as to extend from the interior surface to the exterior surface along a longitudinal axis, and the head portion also having lips formed on each side of the slit having an extending portion which extends towards the hollow interior from the interior surface of the face, and a compression member disposed in the hollow interior of the head portion which is adapted so as to surround the lips.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Embodiments of the invention relate to elastomeric fluid delivery valves which are capable of withstanding leakage at increased pressures. In certain embodiments the fluid delivery valve can comprise a neck region which is adapted to connect to a fluid delivery tube. A head region can extend from the neck region. The head region can comprise a fluid delivery face opposite the neck region. The fluid delivery face can have an openable slit and a perimeter with a compression member surrounding the perimeter. The compression member can reside in a channel located at the face perimeter. The compression member can be configured to apply an increased force perpendicular to the longitudinal axis of the slit to increase the leak pressure of the valve.

As described more fully below, the fluid delivery valve can be utilized in applications where pressurized fluid delivery is desired. Examples of situations where the fluid delivery valve described herein can be utilized are as a personal hydration system during outdoor activities such as hiking, biking and boating. The valve can also be utilized to deliver fluid for body misting to reduce body temperature during physical activities. Additionally, the valve can be used to deliver fluid for cleaning of outdoor equipment such as a bicycle or cooking equipment or to douse a campfire.

Figure 1:
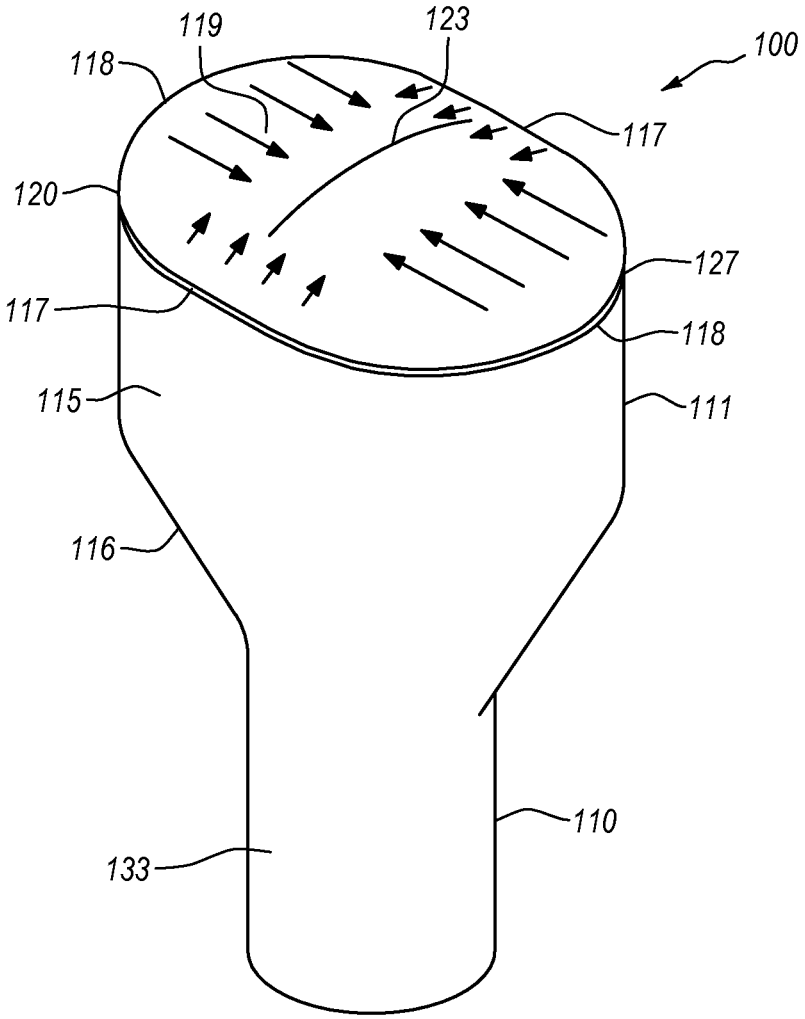
FIG. 1 is a perspective view illustrating a fluid dispensing valve.
Figure 2:
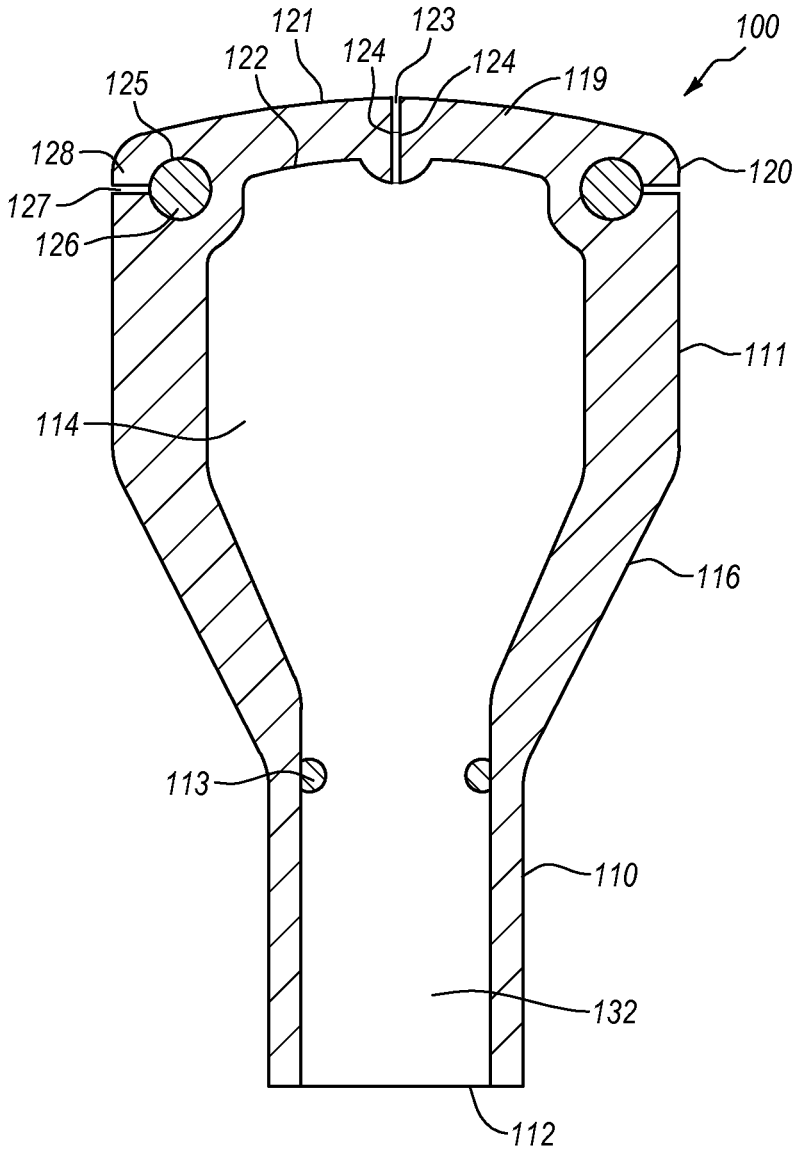
FIG. 2 is a cross-sectional view of the fluid dispensing valve of FIG. 1.

In reference to FIGS. 1 and 2, a fluid delivery valve 100 according to a first embodiment is shown. The valve 100 shown in FIGS. 1 and 2 comprises a neck portion 110 and a head portion 111. The valve 100 can be made from an elastomeric material such as silicone, latex or a thermal plastic elastomer. The material can be clear, translucent or opaque. The material can be a natural color or tinted any color to make the valve 100 more visible. The valve 100 can also be formed as an integral unit using known manufacturing techniques such as liquid injection molding, thermal injection molding, transfer molding or casting. Alternatively, the valve 100 can be formed of separate components which are joined together using known manufacturing techniques such as welding and gluing.

In certain embodiments, the neck region 110 can be generally tubular in shape. The distal end 112 of the neck portion 110 is open and can be sized to frictionally fit over a fluid delivery tube (not shown) creating a fluid tight connection. The fluid delivery tube can be removed from the neck portion 110 for valve cleaning or replacement. The neck internal surface 132 can include a feature 113 to prevent over insertion of the fluid delivery tube into the neck portion 110. The feature 113 can be a shoulder or rib for the end of the fluid delivery tube to abut when inserted into the neck portion 110. The neck exterior surface 133 can include features to facilitate finger gripping during fluid delivery tube insertion or removal. The grip features can be ribs, bumps, or a roughened surface.

With continued reference to FIGS. 1 and 2, the head portion 111 can extend from the neck portion 110 and can be integrally formed with the neck portion 110 or engaged with the neck portion 110 as a secondary assembly process. The head portion 111 can be hollow having a fluid chamber 114. The chamber 114 can be in fluid communication with the neck portion 110. The head transverse cross-section can be generally oval, ellipse, racetrack shaped or any shape having a long axis and a short axis. The head can have opposing side surfaces 117 that are in alignment or parallel with the long axis and end surfaces 118 that are in alignment or parallel with the short axis. The opposing side surfaces 117 and end surfaces 118 form a pinch or bite region 115.

The transition from the valve neck to the valve head can be a tapered region 116. The taper angle can range from approximately 5° to 45°. In a preferred embodiment, the taper 116 angle is approximately 8°.

Figure 7:
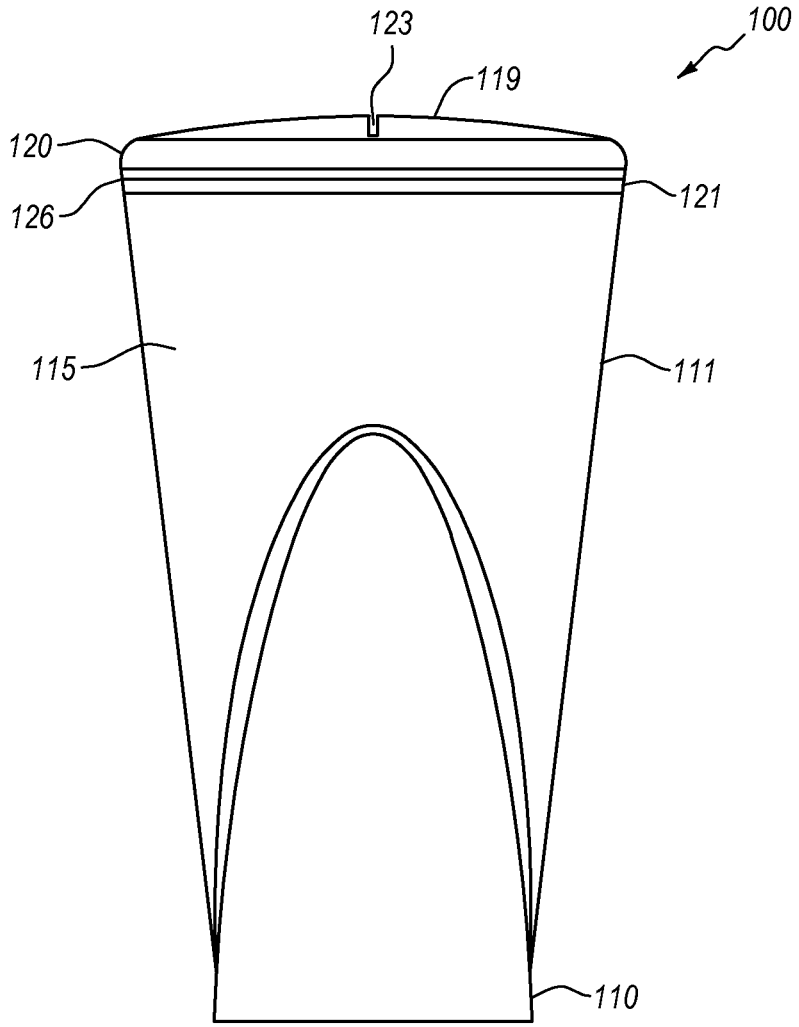
FIG. 7 is a perspective view of a fluid dispensing valve having a tapered head.

Alternatively, as shown in FIG. 7, the side surfaces 117 and end surfaces of head portion 111 can taper from the neck portion 110 to the fluid delivery face 119 forming a generally delta shaped valve 100. The delta shape facilitates easier retention of the valve 100 in the mouth of a user when hydration is desired.

The end of the valve head region 111 opposite the neck region 110 forms a fluid delivery face 119. In the embodiment shown in FIGS. 1-2, the face 119 has a perimeter 120 of the same shape as the head transverse cross-section. The face exterior surface 121 can be a convex shape or be flat surface which is perpendicular to the valve body. The face interior surface 122 can be a convex or concave shape or may be flat and perpendicular to the valve body.

The face 119 includes a slit 123. In the embodiment shown in FIGS. 1-2, the slit 123 extends from near the face perimeter 120 in approximately the middle of one side surface 117 to the area near the perimeter 120 in approximately the middle of the opposite side surface 117 so as to be parallel to the short axis of the face 119. The slit 123 can extend from the face exterior surface 121 to the face interior surface 122. The slit has opposing lips 124 which are in contact with each other when the valve 100 is closed. The slit 123 can be formed in the fluid delivery face 119 during formation of the valve 100 or formed by cutting the face 119 with a sharp blade as a secondary manufacturing operation.

In certain embodiments the valve face perimeter 120 can include a channel 125. A compression member 126 can be positioned in the channel 125. The compression member 126 can be made from an elastomeric material such as silicone, latex or thermal plastic elastomer. The compression member 126 can be an o-ring or elastic band. Alternatively, the compression member 126 can be a retention ring made from spring steel. The compression member 126 can be fully embedded in the perimeter channel 125 or can be partially embedded in the channel 125 such that a portion of the compression member 126 extends outside of the channel 125. A gap 127 in the channel wall 128 can be separated to facilitate positioning or removing of the compression member 126 in the channel 125. The compression member 126 can be removed from the channel 125 for cleaning or replacement.

Figure 3:
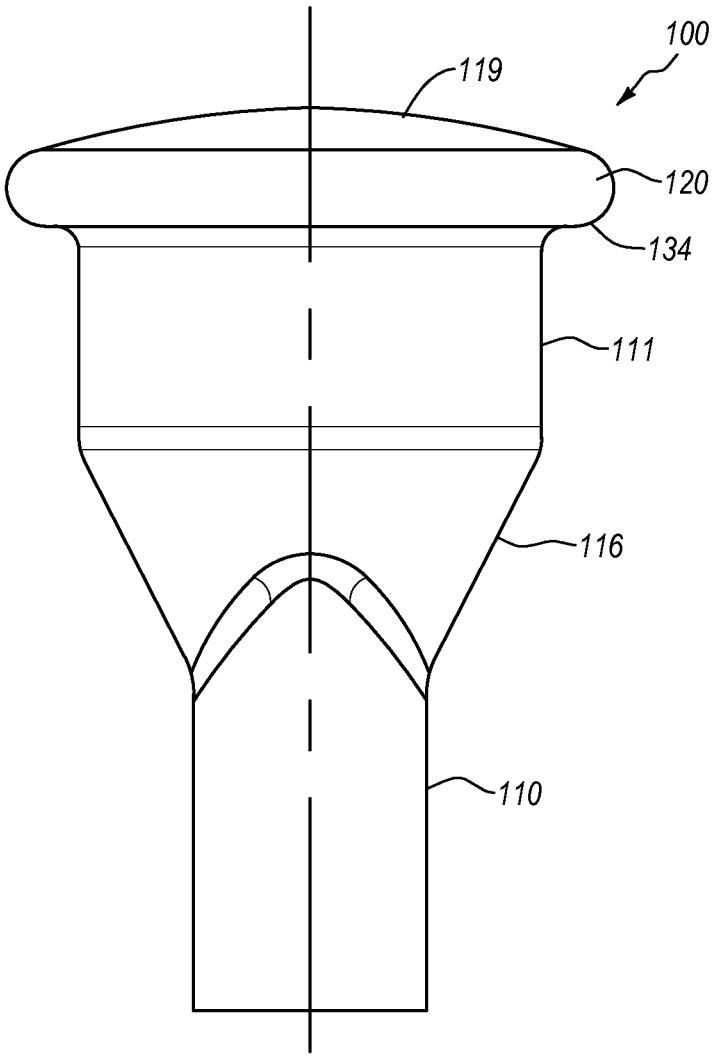
FIG. 3 is a side view of an alternate embodiment of the fluid dispensing valve of FIG. 1 having a fluid dispensing face flange.
Figure 4:
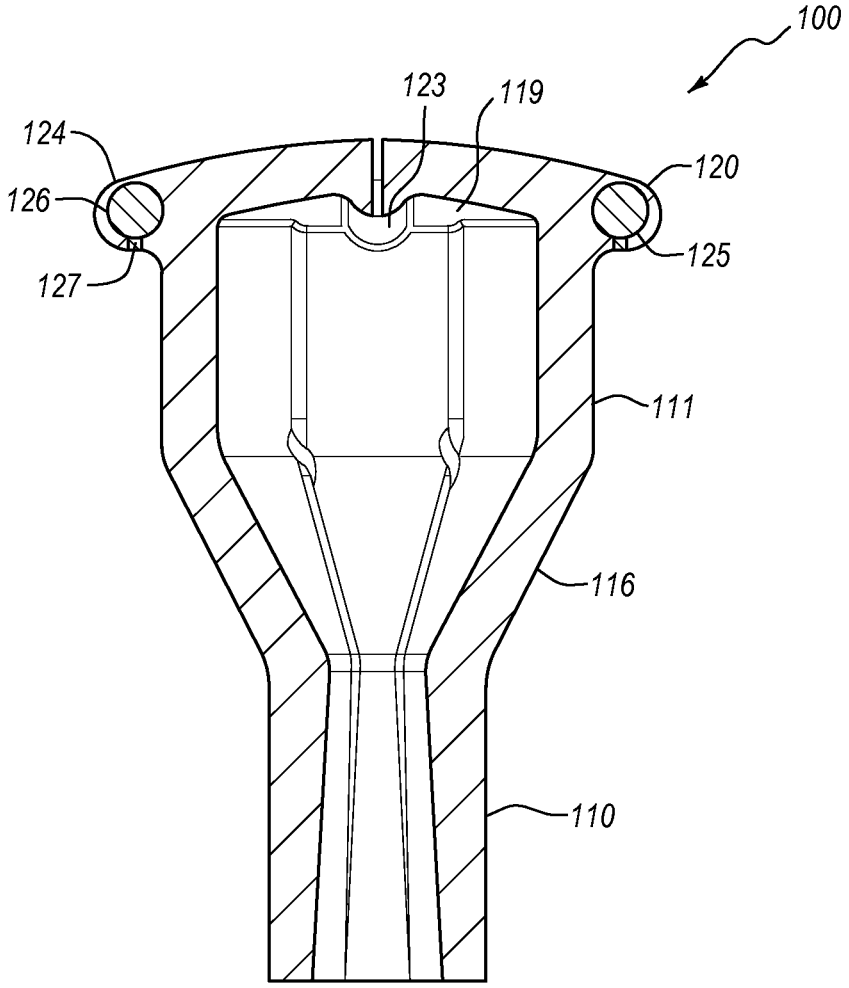
FIG. 4 is a cross-sectional view of the fluid dispensing valve of FIG. 3.

FIGS. 3 and 4 illustrate an alternate embodiment of valve 100. In this embodiment, the valve head region 111 has a dispensing face 119 which includes a perimeter 120. The face perimeter 120 can be a flange 134 that extends radially beyond the exterior surface of the head region 111. In this embodiment, as shown in FIG. 4, the channel 125 is formed within the flange 134. The channel 125 can have a circular, rectangular cross-section or any other cross-section that readily accommodates a compression member 126. The compression member 126 can be at least partially embedded in the channel 125.

Similar to the configuration described above, a gap 127 in the channel wall 128 can be opened to facilitate positioning or removal of the compression member 126 in the channel 125. As such, the compression member 126 may be easily installed during a manufacturing or replacement process and it can also be easily removed for cleaning. Following placement of the compression member 126 in the gap 127, the gap 127 can be sealed with a material such as silicone glue to prevent inadvertent dislodgement of the compression member 126 from the channel 125. Additionally, the sealing of the gap 127 can prevent the colonization of the channel by bacteria.

One aspect of the invention is that the compression member 126 is able to apply a non-equal radial compressive force to the dispensing face 119 and the face slit 123. The compression member 126 can be configured to apply a higher force in the direction perpendicular to the dispensing face slit 123 (as illustrated in FIG. 1 by the long arrows), while a lesser force is applied in the direction parallel to the slit 123 (as illustrated in FIG. 1 by the short arrows). More specifically, the compression member 126 is designed so as to be more easily elongated in an axis perpendicular to the slit 123 than in the axis parallel to the slit 123. An increased elongation of the compression member 126 in the axis perpendicular to the slit 123 results in an increased force being applied to the slit 123 along its perpendicular axis. The increased force on the slit 123 by the compression member 126 results in an increased fluid leak resistance pressure through the slit 123.

Prior art valves which do not have such a compression member generally leak through the valve slit when the fluid inside the valve has a fluid pressure of as low as 1 to 2 psi. Following multiple uses, the prior art valves eventually start to leak at a neutral pressure due to wear of the valve. By contrast, the fluid dispensing valve 100 with the compression member 126 positioned in the dispensing face perimeter channel 125 described herein can withstand a pressure of at least 20 psi prior to leaking.

In certain embodiments compression members 126 having different elastomeric properties can apply an increased or decreased force on the slit 123 resulting in an increased or decreased resistance pressure to leaks. A compression member 126 made from a material with a high elastic modulus or Young's modulus can apply a higher force to the slit 123 than a compression member 126 made from a material with a low elastic modulus. The material of the compression member 126 can be selected with consideration of leak pressure and the amount of bite or pinch force required to open the slit 123.

Thus, a compression member 126 made from a material having a high elastic modulus can apply a high force to the slit 123 and result in a high pressure to leak. At the same time, the high elastic modulus configuration requires a higher bite or pinch force to open the slit 123. This higher bite or pinch force may not be desirable for some users. A selection of compression members 126 having a range of elastic modulii may be desirable to accommodate different users and applications.

In certain embodiments the fluid delivery valve 100 having the compression member 126 can also prevent inflow of fluid into the chamber 114 when fluid pressure on the exterior of the valve 100 is higher than fluid pressure in the valve chamber 114. This provides substantial advantages over prior art valves which merely rely upon the elastomeric characteristics of the valve material to close the slit in the valve face. Over time, the valve material relaxes the force for closing the slit of prior art valves may decrease, allowing leaks at relatively low pressures, especially after much use. In contrast, the fluid delivery valve 100 of the invention can maintain a high leak pressure even after much use due to the compression member 126 applying additional close force to slit 123.

In certain embodiments the compression member 126 can be an off-the-shelf component such as an o-ring, elastic band, or orthodontic band. Alternatively, the compression member 126 can be custom designed and manufactured to optimize the function off the compression member to 126 so as to apply a desired force to the face slit 123 to optimize the leak pressure for a desired application.

Figure 8:
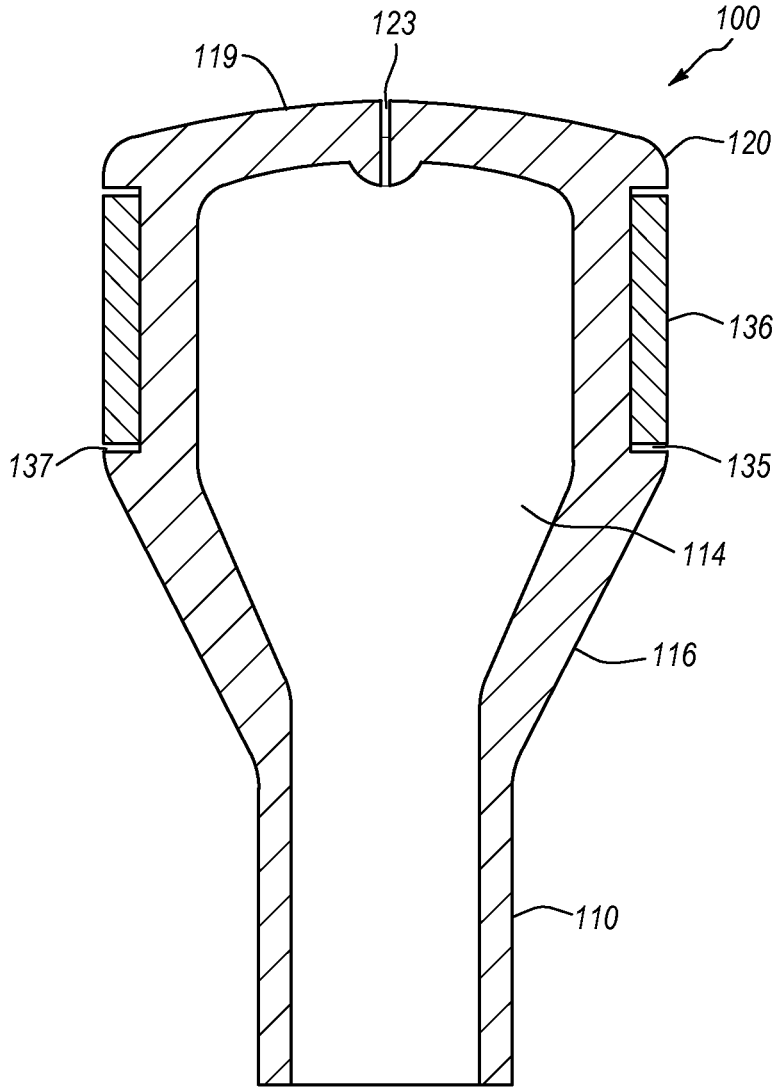
FIG. 8 is a cross-sectional view of a fluid dispensing valve having a wide compression member.

As seen in FIG. 8, the compression member 126 can be a wide band 136 that resides in a recess 135 of the head portion 111. The band 136 can extend from near the face perimeter 120 to near the tapered region 116. The depth of the recess 135 can be approximately equal to the thickness of the band 136 such that the band 136 does not extend outwardly beyond the head surface 137. In certain embodiments the depth of the recess 135 can be greater than the thickness of the band 136. The band 136 can be sealed in the recess 135 with a material such as silicone glue or adhesive. The adhesive can cover the band and at least partially fill the recess 135. The sealed band 136 can prevent inadvertent dislodgement of the band 136 from the recess 135 or catching of the band 136 by the teeth of a user. Additionally, sealing of band 136 with a material such as silicone glue or adhesive can prevent bacteria from colonizing the band 136 and recess 135 and causing an infection of a user by transmission of the colonized bacteria into the mouth and gastrointestinal tract of a user.

In an alternate embodiment, the fluid delivery valve can comprise a neck portion which is adapted to connect to a fluid delivery tube. A head portion can extend from the neck region. The head can form a chamber. The head portion can comprise a fluid delivery face opposite the neck region. The fluid delivery face can have an openable slit. The slit can have opposing lips with lip extensions extending into the head chamber. A compression member can surround the lip extensions. The compression member is configured to apply an increased force to the longitudinal axis of slit to increase the leak pressure of the valve.

Figure 5:
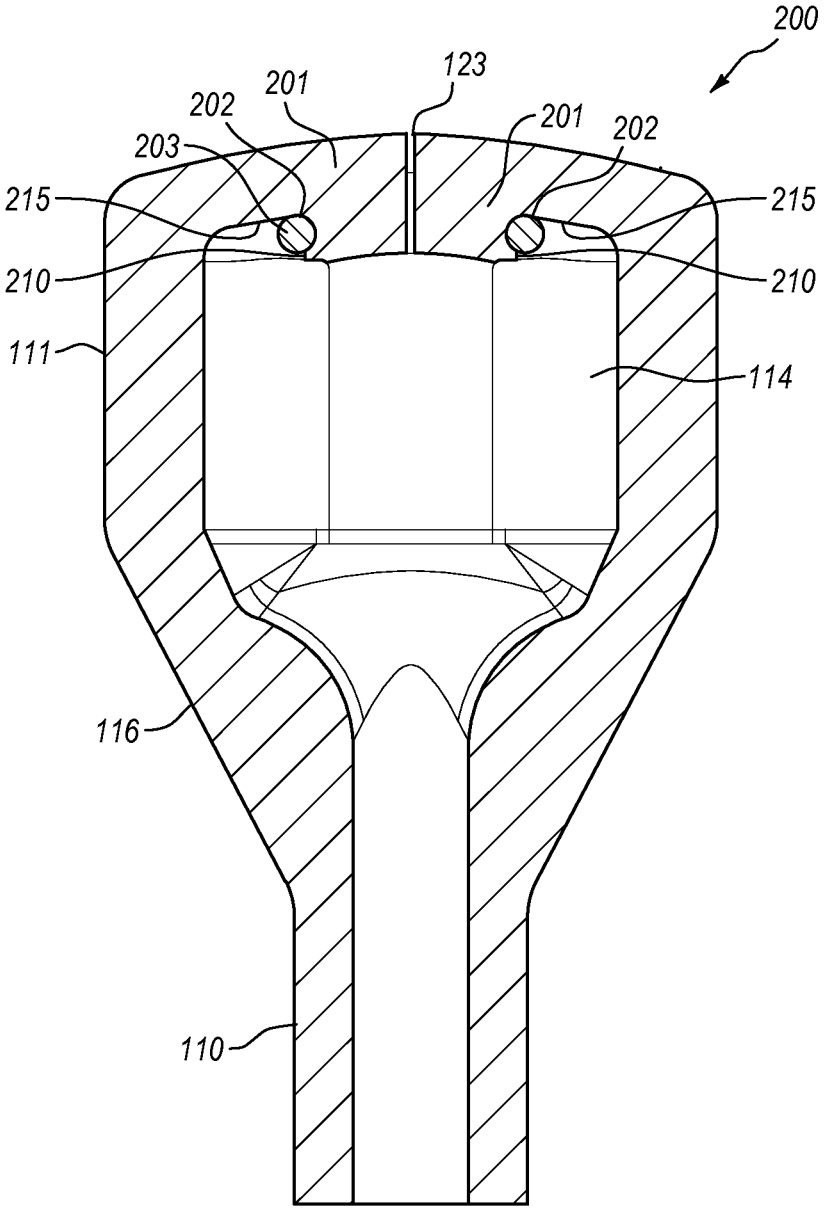
FIG. 5 is a cross-sectional view of a fluid dispensing valve having an internally positioned compression member.

FIG. 5 illustrates such an alternate embodiment of the fluid delivery valve 100. The fluid dispensing face 119 can comprise a slit 123 extending from near the perimeter 120 near the center of side 117 to near the perimeter 120 of the opposite side 117. The slit 123 can have opposing lips 124 and lip extensions 201. The lip extensions 201 extend from the face interior surface 215 into the head chamber 114. The extensions 201 can include a channel 202 located on the extension exterior surface between the extension end 210 and the junction of the extension end 210 with the dispensing face interior surface 215.

A compression member 203 can be positioned in the lip channel 202 surrounding the lip extensions 201. The compression member 203 can be configured to apply a non-equal radial force to the slit 123. The compression member 203 can be configured to apply a higher force perpendicular to the slit 123 than parallel to the slit 123. The compression member 126 can be elongated to an increased extent in the axis perpendicular to the slit 123 than in the axis parallel to the slit 123. The increased elongation of the compression member 203 in one axis can result in an increased force being applied to the slit 123 along its perpendicular axis. The increased force on the slit 123 can result in an increased fluid leak pressure through the slit 123. Without the compression member 203 surrounding the slit lip extensions 201, the fluid delivery valve 100 can leak when the pressure in the head chamber reaches less than 1 psi. With a compression member 203 positioned in the lip extension channel 131, the pressure to leak can be increased to at least 20 psi.

As with the other embodiments described above, in certain embodiments compression members 203 having different elastomeric properties can apply a higher or lower force on the slit 123 resulting in a higher or lower pressure to leak. A compression member 203 made from a material with a high elastic modulus or Young's modulus can apply a higher force to the slit 123 than a compression member 203 made from a material with a low elastic modulus.

Figure 6:
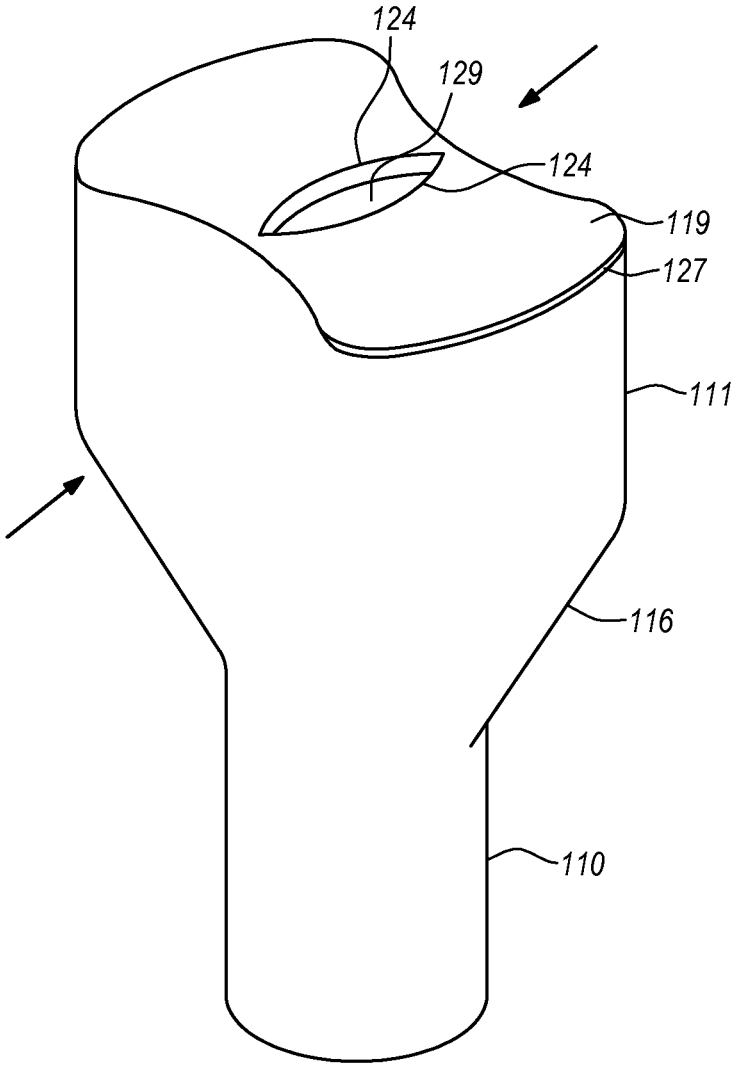
FIG. 6 is perspective view of the fluid dispensing valve of FIG. 1 in the valve open position.

FIG. 6 illustrates the fluid dispensing valve 100 having a compression member 203 or 126 according to any of the embodiments described herein. As described above, the tube end of the neck portion 110 can be connected to a fluid reservoir. The fluid in the reservoir can be pressurized to between about 0 psi and about 15 psi. When fluid dispensing from the valve 100 is desired, a compression force perpendicular to the longitudinal axis of the slit 123 is applied to the pinch portion 115 of the valve 100. The force may be exerted by a user's fingers or teeth or by a tool such as pliers. The force can distort the valve head portion 111 including the dispensing face 119. The distortion causes the slit lips 124 to separate and an aperture 129 to be formed in the dispensing face 119. Fluid then flows from the fluid reservoir, into the delivery tube, into the neck portion 110, into the head chamber 114 and out of the valve 100 through the aperture 129. When the valve head portion 111 is biased by compression on the pinch or bite region 115, the slit 123 is distorted along its longitudinal axis causing the slit lips 124 to separate and forming an aperture 129 in the face 119. When the compressive force is released from the pinch or bite region 115, the elastomeric characteristic of the valve material and the compression member 126 or 203 causes the valve head portion 111 to spring back to a relaxed positioned. The valve face 119 and slit 123 also return to a relaxed position closing the aperture 129 in the fluid dispensing face 119.

The size of the aperture 119 can be controlled by the amount of force applied to the valve pinch region 115. A higher force can result in a larger aperture 119. A larger aperture can facilitate a higher flow of fluid dispensed from the valve 100. A lower force applied to the pinch region 115 of the valve 100 will result in a smaller aperture and a smaller fluid flow from the valve 100. The dispensed fluid can be utilized for personal hydration, body misting to reduce body temperature, bicycle or other outdoor equipment cleaning, cleaning of cooking and eating utensils and dousing of a campfire.

Figure 9:
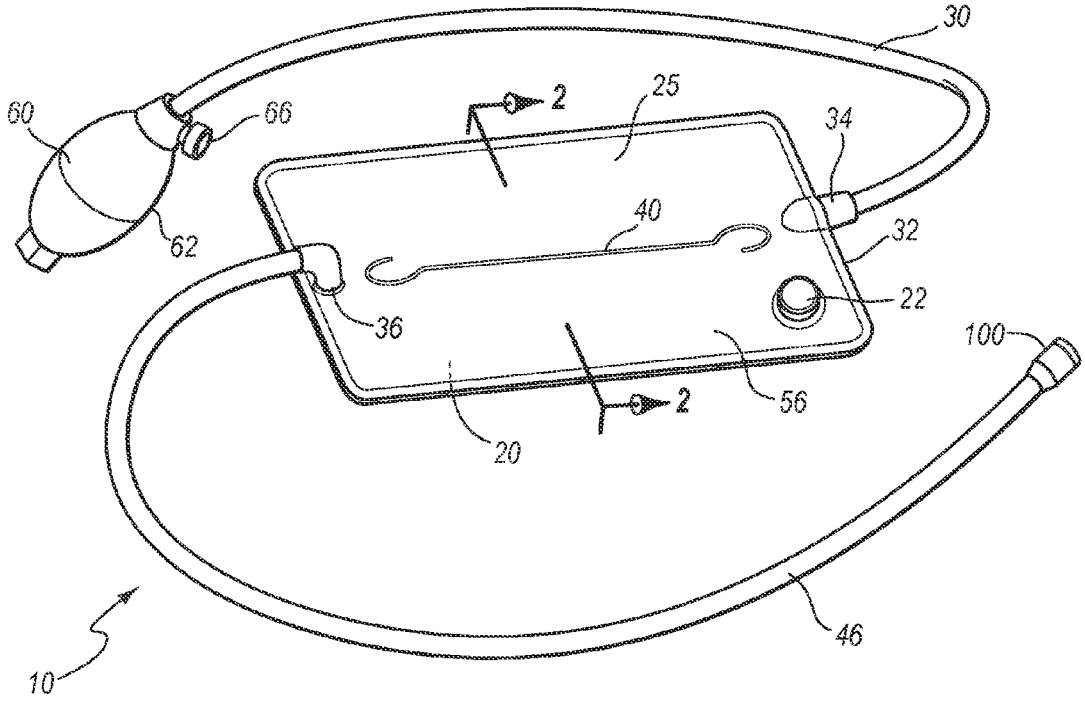
FIG. 9 is a perspective view of a fluid dispensing system which incorporates the fluid dispensing valve.
Figure 10:
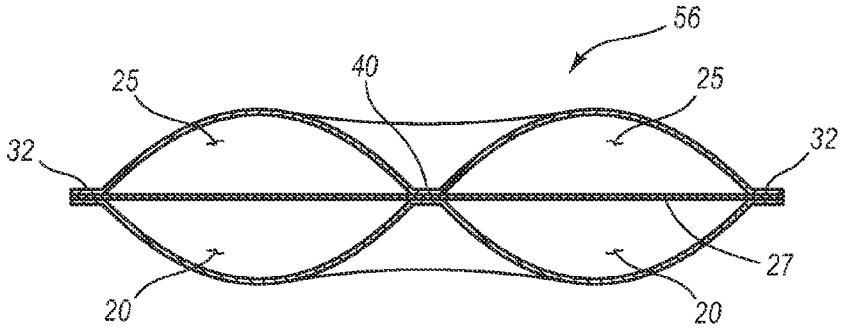
FIG. 10 is a cross-sectional view of the fluid dispensing system of FIG. 9.

FIGS. 9 and 10 illustrate an example of a pressurizable fluid delivery system, indicated generally at 10, which may be used in association with the valve 100 described above. The fluid delivery system is configured so as to deliver a portable, pressurized stream of liquid from an integrated, pressurized fluid reservoir 56. The integrated, pressurized fluid reservoir 56 is comprised of a fluid bladder portion 25 and a pressurizable portion 20 which is disposed adjacent to the fluid bladder portion 25. The fluid bladder portion 25 may be filled with a desired liquid, such as water, an electrolyte replacement drink, or the like. A pressure inducer 60, such as a pump, can be operably coupled to the pressurizable portion to supply pressure to the pressurizable portion 20 of the pressurized fluid reservoir 56. The pressurizable fluid delivery system 10 includes the valve 100 that can be operatively coupled to the fluid bladder portion 25 so as to selectively release fluid from the fluid bladder portion 25.

The pressurized fluid reservoir 56 may by comprised of a flexible plastic material suitable for containing both liquid fit for human consumption and an inflatable gas. In one embodiment described more fully below, the exterior of the pressurized fluid reservoir 56 is comprised of a durable flexible plastic material capable of resisting ripping or tearing, whereas an interior membrane 27 (shown in FIG. 10) of the pressurized fluid reservoir 56 which forms a dividing wall between the fluid bladder portion 25 and the pressurizable portion 20 is formed of a second plastic material.

The pressurized fluid reservoir 56 includes an inlet 22 and an outlet 36 which are connected to the fluid bladder portion 25 of the pressurized fluid reservoir 56. The inlet 22 can be sized and shaped to allow the fluid bladder portion 25 to be filled with the desired liquid and also with a cooling material, such as ice. A lid 28 can close and seal the inlet 22 to restrict leakage of the liquid.

The outlet 36 can be a hole positioned at an opposite end (or another location) of the fluid bladder portion 25 of the pressurized fluid reservoir 56 from the inlet 22. A flexible tube 46 can be coupled to the outlet 36 and can carry liquid from the fluid bladder portion 25 of the pressurized fluid reservoir 56 to a desired release location, such as a user's mouth. As described above, the valve 100 having improved leakage resistance to the pressurized fluid can close the end of the tube 46 in order to restrict fluid from leaking from the tube 46.

As shown in FIG. 10, in this configuration the pressurizable portion 20 of the pressurized fluid reservoir 56 is formed adjacent to the fluid bladder portion 25. As shown in FIG. 2, the pressurizable portion 20 comprises a chamber that is capable of being pressurized, which, when inflated and pressurized, causes pressure to be applied to the adjacent fluid bladder portion 25 so as to pressurize the fluid and cause the fluid to flow to the tube 46 and to the valve 100.

Thus, embodiments of the invention provide a valve and a fluid delivery system which are capable of reliably delivering pressurized fluid from the valve when the valve is in an open position while reducing leaks when the valve is in the closed position. Furthermore, embodiments of the invention are able to withstand the force of the pressurized fluid while providing a simple and reliable method of delivering the pressurized fluid by using a valve which may be released using the relatively small force of a human bite or pinch. As may be understood by one of skill in the art, the embodiments described herein provide a simple and resilient delivery system for a pressurized fluid.

Various modifications, changes, and variations apparent to those of skill in the art may be made in the arrangement, operation, and details of the apparatus and methods detailed in this disclosure without departing from the spirit and scope of the disclosure. Thus, it is to be understood that the embodiments described above have been presented by way of example, and not limitation. Any suitable combination of the features described above is contemplated. Moreover, each embodiment recited in the claims that follow represents a separate embodiment.

What is claimed is:

1. A fluid delivery valve comprising:

a neck portion adapted to connect to a fluid delivery tube;

a head portion having a hollow interior and extending from the neck portion, the head portion comprising a dispensing face having an exterior surface and an interior surface, the face also having a slit formed so as to extend from the interior surface to the exterior surface along a longitudinal axis, and the head portion also having lips formed on each side of the slit having an extending portion which extends towards the hollow interior from the interior surface of the face; and a compression member disposed entirely within the hollow interior of the head portion and which is adapted so as to surround the extending portion of the lips which extend towards the hollow interior of the head portion.

2. The fluid delivery valve of claim 1, wherein the compression member is adapted so as to apply a greater force to the slit in a direction perpendicular to the longitudinal axis so as to cause the slit to close while applying a lesser force to the longitudinal axis of the head portion.

3. The fluid delivery valve of claim 1, wherein the lips have a groove formed therein on an outer edge of the lips where the extending portion of the lips joins the interior surface of the head portion, and wherein the groove houses the compression member.

4. The fluid delivery valve of claim 1, wherein the compression member comprises an elastomeric material such as silicone, latex, or thermal plastic elastomer.

5. A fluid delivery system comprising:

a collapsible fluid reservoir having a filling port and a fluid exit port and being adapted so as to be pressurized by a pressure inducer;

a fluid delivery tube having a proximal end connected to the fluid exit port and a distal end; and a fluid delivery valve comprising:

a neck portion adapted to connect to the distal end of the fluid delivery tube;

a head portion comprising a dispensing face with a perimeter and a slit having lip extensions which extend from an interior surface of the head portion to into a chamber within the head portion; and a compression member disposed entirely within the interior surface of the head portion so as to surround the lip extensions in the chamber within the head portion, wherein the compression member is adapted to apply a force to the lip extensions of the slit.

6. The fluid delivery system of claim 5, wherein the head portion further comprises a groove formed in the perimeter surrounding the lip extensions of the head portion which defines a cavity and wherein the compression member is disposed within the cavity of the groove.

7. The fluid delivery system of claim 5, wherein the head portion has a shape with a long axis and a short axis, wherein the slit is formed in the head portion so as to be parallel with the short axis, and wherein the compression member is adapted so as to apply a greater force to the long axis of the head portion so as to cause the slit to close while applying a lesser force to the short axis of the head portion.

8. The fluid delivery system of claim 5, wherein the compression member comprises an elastomeric material such as silicone, latex, or thermal plastic elastomer.

9. The fluid delivery system of claim 1, wherein the head further comprises a tapered region adapted so as to join the dispensing face and perimeter of the head portion to the neck portion, and wherein compression member comprises a band which extends from the perimeter of the head portion to the tapered region.

10. A fluid delivery system comprising:

a collapsible fluid reservoir having a filling port and a fluid exit port and being adapted so as to be pressurized by a pressuring means;

a fluid delivery tube having a proximal end connected to the fluid exit port and a distal end; and a fluid delivery valve comprising:

a neck portion adapted to connect to the distal end of the fluid delivery tube;

a head portion having a hollow interior and extending from the neck portion, the head portion comprising a dispensing face having an exterior surface and an interior surface, the face also having a slit formed so as to extend from the interior surface to the exterior surface along a longitudinal axis, and the head portion also having lips formed on each side of the slit having an extending portion which extends towards the hollow interior from the interior surface of the face; and a compression member disposed entirely within the hollow interior of the head portion and which is adapted so as to surround the extending portion of the lips which extend towards the hollow interior of the head portion.

11. The fluid delivery system of claim 10, wherein the compression member is adapted so as to apply a greater force to the slit in a direction perpendicular to the longitudinal axis so as to cause the slit to close while applying a lesser force to the longitudinal axis of the head portion.

12. The fluid delivery system of claim 10, wherein the lips have a groove formed therein on an outer edge of the lips where the extending portion of the lips joins the interior surface of the head portion, and wherein the groove houses the compression member.

13. The fluid delivery system of claim 10, wherein the compression member comprises an elastomeric material such as silicone, latex, or thermal plastic elastomer.

14. The fluid delivery valve of claim 1, wherein the compression member is configured to be removable from the head portion for replacement or cleaning.

15. The fluid delivery system of claim 5, wherein the compression member is configured to be removable from the head portion for replacement or cleaning.

16. The fluid delivery system of claim 10, wherein the compression member is configured to be removable from the head portion for replacement or cleaning.

* * * * *